United States Patent [19]

Herman, Jr.

[11] Patent Number: 4,495,666

[45] Date of Patent: Jan. 29, 1985

[54] BATHTUB CUSHION LIFT ASSEMBLY

[75] Inventor: Harry H. Herman, Jr., Chevy Chase, Md.

[73] Assignee: International Healthcare Products, Inc., Washington, D.C.

[21] Appl. No.: 483,301

[22] PCT Filed: Mar. 9, 1981

[86] PCT No.: PCT/US81/00290

§ 371 Date: Mar. 1, 1983

§ 102(e) Date: Mar. 1, 1983

[87] PCT Pub. No.: WO82/03002

PCT Pub. Date: Sep. 16, 1982

Related U.S. Application Data

[63] Continuation-in-part of Ser. No. 054,794, Jul. 10, 1979.

[51] Int. Cl.[3] ..... A47K 3/12

[52] U.S. Cl. ..... 4/564; 4/575; 4/578; 4/583; 4/565; 4/566

[58] Field of Search ..... 4/564–566, 4/144.2, 575, 578, 581, 583

[56] References Cited

U.S. PATENT DOCUMENTS

| | | | |
|---|---|---|---|
| 1,641,029 | 8/1927 | Gaudet | 4/581 X |
| 2,167,178 | 7/1939 | Kohlstadt | 4/575 |
| 2,461,880 | 2/1949 | Curran | 4/575 |
| 2,725,578 | 12/1955 | Keller | 4/566 X |
| 3,050,748 | 8/1962 | Deutinger | 4/578 X |
| 3,311,930 | 4/1967 | Bourke | 4/566 |
| 3,346,885 | 10/1967 | Merriman | 4/566 |
| 3,403,410 | 10/1968 | Benzel et al. | 4/144.2 |
| 3,408,663 | 11/1968 | Bunting | 4/581 |
| 4,047,259 | 9/1977 | Lotis | 4/583 X |
| 4,254,517 | 3/1981 | Herman, Jr. | 4/564 |

*Primary Examiner*—Henry K. Artis

*Attorney, Agent, or Firm*—Beveridge, DeGrandi and Kline

[57] ABSTRACT

An improved inflatable cushion lift assembly for use in a bathtub by a person taking a bath. The lift assembly is positioned on the floor of a bathtub and is connected to the bathtub faucet to inflate the cushion. The cushion may be deflated while a person is sitting thereon to lower a person to the floor of the tub. Furthermore, the cushion may be inflated while the person is sitting on the cushion on the floor of the tub to raise the user upwardly to allow the user to exit the tub easily. The present improvement inhibits undesired movement of the cushion while being used by utilizing a rigid bottom panel and/or rigid top panel. Furthermore, the interior of the cushion may be provided with baffles or the like for dampening water oscillations within the cushion. The cushion, for reasons of stability, may also be tiered or formed in layers such that the cushion inflates or deflates in stages. In another embodiment, the cushion may be placed in a rigid chairlike structure having an apparatus on the chair back which cooperates with a side wall of the cushion to guide the cushion during raising or lowering thereof. In yet another embodiment, a foldable valve is provided for effecting controlled discharge of the water within the cushion. In another embodiment, a plurality of interconnecting plates generally lining the side walls, rear wall, and floor of the bathtub are utilized to assist a bather safely in getting on and off the cushion lift and in maneuvering himself safely within the bathtub during bathing.

30 Claims, 10 Drawing Figures

BATHTUB CUSHION LIFT ASSEMBLY

This application is intended as an INTERNATIONAL APPLICATION and is a continuation-in-part of U.S. patent application Ser. No. 054,794 filed July 10, 1979, the benefit of which filing date is hereby claimed.

TECHNICAL FIELD AND BACKGROUND ART

It is extremely difficult for many people to take unattended baths because of the configuration of a conventional bathtub. Persons such as the handicapped, convalescents, expectant mothers, and the elderly often find it extremely difficult to utilize conventional bathtubs without assistance, and such difficulties are often focused on their inability to lower themselves into the tub, and upon completion of the bath, to lift themselves out of the tub. Not only is the entrance and exit into and out of the tub for such users fraught with considerable difficulties, it is also extremely dangerous due to the ever present possibility of slippage.

Bathtub cushion lift assemblies are known in the art such as described in U.S. Pat. No. 3,771,176. In this patent, a cushion lift is described which has an inflatable shell adapted to be positioned on the floor of a bathtub and is connected to the bathtub spout or faucet. Water under pressure is fed through the bathtub spout into the inflatable shell to selectively inflate it to its full elevation wherein its supporting surface is elevated to the approximate height of the bathtub walls to provide a cushionlike support that a person desirous of taking a bath may sit. Once seated on the cushionlike support in the bathtub, the cushion may be deflated whereby the person sitting thereon is gradually lowered to the floor of the bathtub. After the bath is completed, the shell may once again be filled to elevate the user upwardly to the top of the bathtub whereby the user may then exit the tub easily.

The prior bathtub cushion lift assemblies have provided apparatus helpful for persons such as elderly persons taking a bath; however, persons who have balance problems have need of more specialized lift assemblies. In particular, persons such as paraplegics require a cushion lift assembly which is very stable during inflation and deflation of the cushion lift. It is important to these persons that the lift assembly not tilt, rotate, slide or otherwise shift position during the course of bathing. Moreover persons such as severe handicaps and those with other special mobility problems require greater aid in getting on and off cushion lifts and in maneuvering within the bathtub than has been provided by prior bathtub lift assemblies.

DISCLOSURE OF INVENTION

This invention overcomes the difficulties of prior bathtub cushion lift assemblies in providing a stable cushion lift assembly which utilizes features for preventing or tending to prevent tilting, rotation, sliding or shifting position of the cushion lift assembly during use thereof.

In the present invention rigid members are disposed on either the top surface of the cushion or the bottom surface of the cushion or both to minimize undesired movement of the cushion during use. The interior of the cushion may be provided with baffles or the like for dampening water oscillations within the cushion. Furthermore, the cushion may be tiered or formed in layers so that the cushion may be inflated or deflated in stages for added stability. Also the cushion may be placed in a rigid chairlike structure having an apparatus on the chair back which cooperates with a side wall of the cushion to guide the cushion during raising or lowering thereof. Furthermore, a foldable valve may be provided for effecting controlled discharge of the water from within the cushion. A plurality of interconnecting plates generally lining the side walls, rear walls, and floor of the bathtub may be utilized to assist a bather safely in getting on and off the cushion lift and in maneuvering himself safely within the bathtub.

Thus, with the present invention, a stable bathtub cushion lift assembly is provided which maintains its stability during inflation and deflation of the cushion and which aids a bather in getting out and off the lift and in maneuvering himself within the bathtub.

For a better understanding of the invention, reference may be made to the following descriptions of representative embodiments, taken in conjunction with the figures of the accompanying drawings in which:

MODES FOR CARRYING OUT THE INVENTION AND INDUSTRIAL APPLICABILITY

Figure 1:
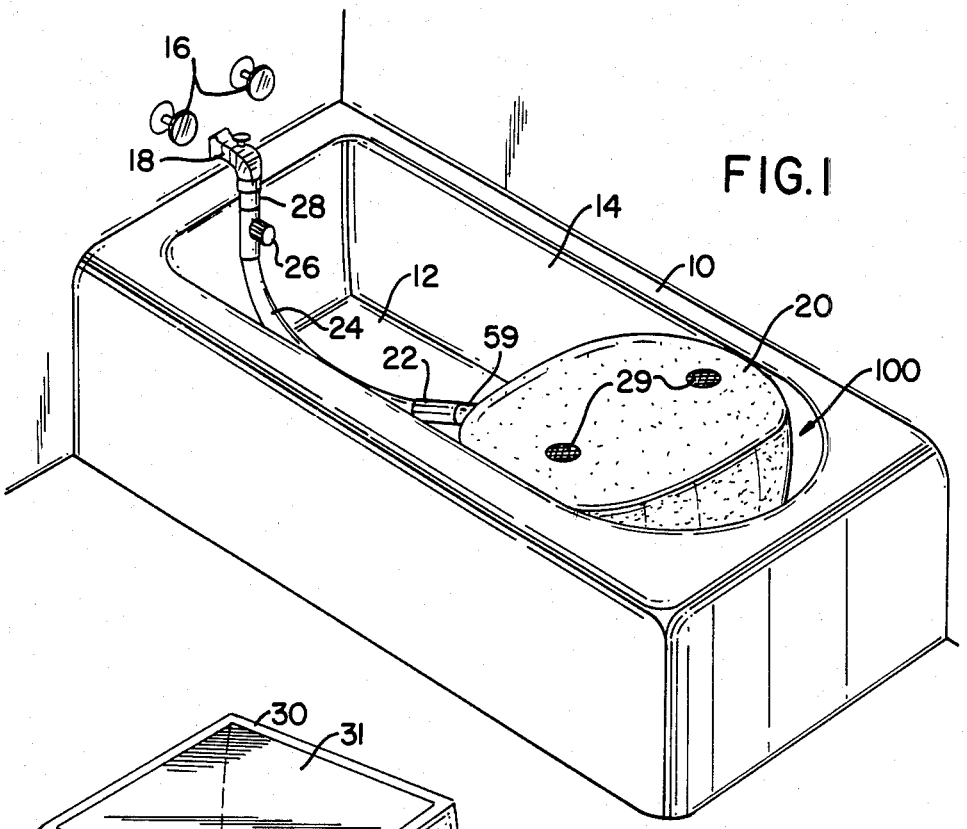
FIG. 1 is an oblique view of a bathtub containing an inflated cushion lift assembly according to the present invention.

A conventional bathtub 10 is shown in FIG. 1 having a floor 12 and substantially vertical side walls 14. Water is introduced into the bathtub through conventional hot and cold valves 16 and a common faucet or spout 18 as shown. It being understood that individual conventional hot and cold faucets could also be used.

The cushion lift assembly of the present invention is an improvement for the cushion lift assembly described in U.S. Pat. No. 3,771,176 and includes a selectively shaped inflatable shell 20 having a shell connector 59 which is connected by a standard connector to sleeve valve 22. Sleeve valve 22 is included within filler tubing 24 at one end thereof, the other end of filler tubing 24 is connected to a pressure relief valve 26 and an elastic sleeve 28 and associated sealing means. The sleeve 28 is adapted to snugly fit over the bathtub spout 18 and to be secured thereto in essentially watertight relation. Were the bathtub provided with a corresponding faucet for each of the hot and cold valves 16, the elastic sleeve 28 could be T-shaped so as to connect the hot and cold faucets with filler tubing 24.

The shell 20 is suitably formed of highly flexible sheet material of requisite strength and of limited elasticity. Suitable materials include resinous water impervious sheet materials, such as vinyl sheet or the like. Such shell 20 is preferably constituted so as to be of generally rectangular polyhedron shaped when in inflated condition, and of a transverse dimension that will compressively engage the side walls of the bathtub with which it is to be used.

Water under pressure for shell inflation is supplied to the cushion lift assembly through the bathtub spout 18. Such water will pass through the elastic sleeve 28, the pressure relief valve 26, the length of filler tube 24 and the sleeve valve 22 into the inflatable shell 20.

Any air which is either present in the deflated shell or which is introduced thereinto as a part of the incoming water stream may escape through automatic relief valves 29 in the form of button screens having a bottom layer of foam rubber secured to the bottom thereof. These automatic air relief valves release the air while preventing the discharge of the water from within the shell.

The safety or pressure relief valve 26 opens when the pressure of the water within the shell reaches a predetermined level. This prevents a pressure build-up within the shell beyond that level thereby protecting the shell from rupture or other failure due to excess pressure.

The sleeve valve 22 is a conventional valve and is described in U.S. Pat. No. 3,711,176. In operation, a sleeve with holes is rotated to align these holes with corresponding holes in tube 24, to deflate shell 20. Furthermore, the rate of discharge is controllable so that the cushion may be lowered at a rate comfortable for a person seated on such cushion.

In operation of the described unit, water from spout 18 is directed through the filler tube 24 to shell 20 to inflate such shell. The shell will continue to inflate until it reaches a fully inflated condition and the pressure therewithin builds up to a magnitude equal to the pressure at which the pressure release mechanism will become operable. At this point, the side walls of the shell 20 will compressively engage the walls of the bathtub and the upper surface thereof will be at a height substantially equal to the height of the bathtub walls. A person sits on the side of the bathtub, slides over onto the upper surface of the cushion, swivels his legs over the side of the bathtub, and opens the sleeve valve 22 allowing the water to be discharged from the cushion whereupon the shell will become deflated at a slow rate, thus lowering the person gradually to the floor of the bathtub.

During the bath, the bather may rinse himself by disconnecting the shell connector 59 and using the filler tube 24 to direct a flow of water over him.

When the person desires to get out of the bathtub, the sleeve valve 22 is closed, the faucet fitting 28 is replaced in position if it has been removed and the water is turned on causing the shell to again become inflated, and to effect a selectively directed elevation of the person up to the top of the side walls of the bathtub. The person then swivels his legs over a side of the bathtub onto the floor and stands up.

Persons suffering from balance problems such as paraplegics require bathtub cushion lift assemblies which are stable and will not tilt, rotate, slide or otherwise shift position during the course of bathing.

Figure 2:
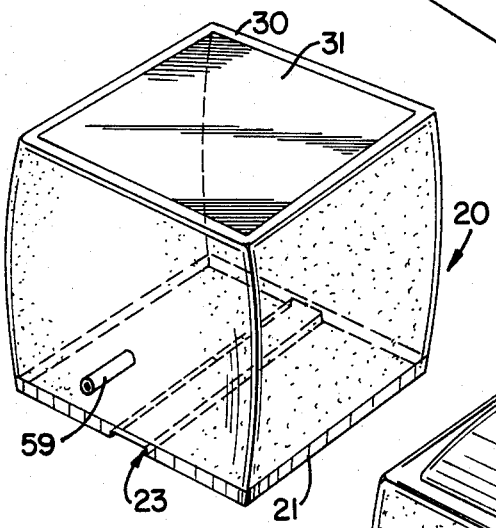
FIG. 2 is an oblique view of one embodiment of the cushion lift assembly according to the present invention showing a rigid seat disposed on the top panel of the cushion, a rigid bottom panel and a bottom channel for directing water under the cushion.

One embodiment of the present invention directed to this end is shown in FIG. 2. The shell 20 includes a floor bottom panel 21 constructed of rigid material. This structure tends to stabilize the shell 20 when inflated and tends to prevent undesired rolling or rotation of the shell 20 when the cushion lift assembly is being used. The rigid bottom panel tends to prevent undesired rolling or rotation of the shell by inhibiting the rolling, rotation, crumpling or other displacement of the bottom panel when the shell is substantially deflated and the bather sitting thereon causes the shell to move. This function may be substantially accomplished if only a portion of the bottom panel is constructed of rigid material, which may extend from one edge to an opposite edge of the bottom panel.

The bottom panel 21 may be provided with a channel 23 as shown in FIG. 2 passing from the front of the shell 20 to the rear thereof which would permit water otherwise trapped between the rear wall of shell 20 and the rear wall of the bathtub, designated 100 in FIG. 1, to flow to the bathtub drain.

FIG. 2 also shows another embodiment of the present invention having a selectively shaped seat 31 disposed on the top panel 30 of the shell 20. The seat 31 may be constructed of rigid material and may be integral with or attached to the top panel 30 of the shell 20 by bonding such as with an adhesive or by snaps, Velcro strips or other such means (not shown).

Figure 3:
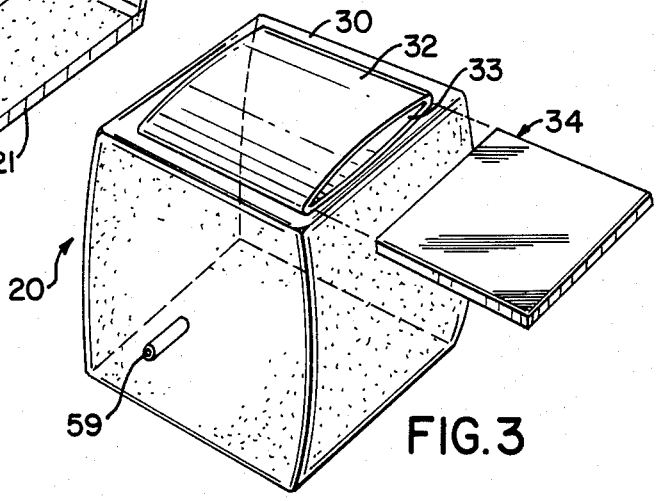
FIG. 3 is an oblique view of another embodiment of the cushion lift assembly according to the present invention having a removable rigid seat assembly.

FIG. 3 shows another construction of a shell 20 having a seat. Here the top panel 30 of shell 20 is provided with an envelope 32 into which a substantially rigid seat panel 34 may be inserted. The mouth 33 of the envelope 32 may be provided with a plastic zipper, snaps, Velcro tape, or other suitable means (not shown) for closing the envelope to retain the panel 34 therein and to prevent dirt from entering the envelope.

The seat constructions as described and shown in FIGS. 2 and 3 aid in stabilizing the top panel 30 of the shell 20 as it inflates and deflates, and also prevents the crumpling of and other displacement of the top panel 30 when there is little or no water in the shell 20.

Figure 4:
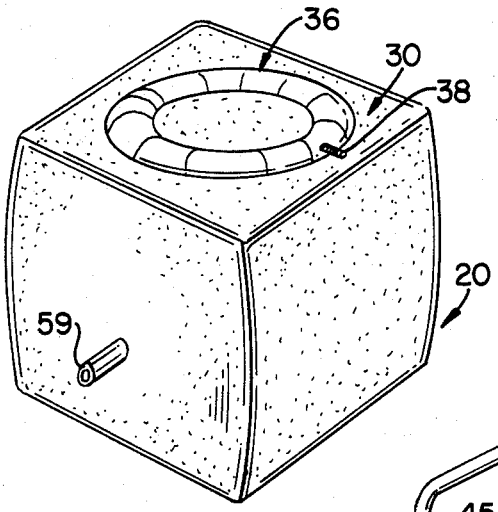
FIG. 4 is an oblique view of another embodiment of the cushion lift assembly according to the present invention having an inflatable seat assembly.

Another type of seat construction is shown in FIG. 4, where the seat comprises an air inflatable cushion 36 which may be separately attached to or formed on the top panel 30 of shell 20. The cushion is fashioned, for example, in a generally toroidal shape thereby forming a continuous ringlike ridge on the top panel 30 and is provided with a nozzle 38 for inflating the cushion 36. Alternately, the cushion 36 could be inflated by the air in shell 20 which would otherwise escape through relief valves 29 as shown in FIG. 1 when the shell 20 is filled with water. The cushion 36, when inflated, is designed to minimize sliding by the user when sitting on the cushion either when the shell 20 is inflated or when the shell 20 is virtually deflated. It should of course be realized that although the cushion 36, as shown in FIG. 4, is toroidal, various other shapes would also be effective. Furthermore, the cushion 36 could be inflated with other fluids, or the cushion 36 could be non-inflatable and be fashioned of foam, rubber, or the like.

Figure 5:
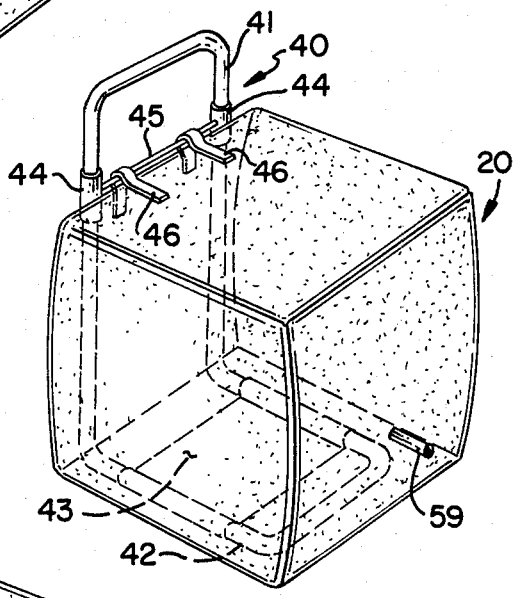
FIG. 5 is an oblique view of another embodiment of the cushion lift assembly according to the present invention including a chairlike frame assembly for cooperating with straps on a wall of the cushion lift assembly to support and guide the cushion as it is inflated and deflated.

FIG. 5 displays a rigid frame assembly 40 which may be foldable or collapsible and may be fashioned of plastic or aluminum tubing or the like for guiding the shell 20 during inflation and deflation thereof. The frame assembly 40 includes a vertically extending "U" shaped back frame portion 41 with the open ends connecting to open ends of a horizontally extending "U" shaped base frame portion 42. Extending between the arms of the "U" shaped base frame portion 42 is a flexible supporting material 43 such as plastic webbing.

A tubular guide 44 concentrically surrounds each of tubular arms of the "U" shaped back frame portion 41. A cross member 45 is attached to and extends between the tubular guides 44. The tubular guides 44 are sized to slidably move on the tubular arms of back frame portion 41.

In a preferred embodiment, the shell 20 is provided with straps 46 which extend around the cross member 45 as shown in FIG. 5; however, other means could be used to attach the shell 20 to cross member 45 and are intended to be within the scope of this invention.

In use, the frame assembly 40 is positioned in the bathtub with the base frame portion 42 positioned on the floor of the bathtub and under the bottom panel of the shell 20. As the shell 20 is filled with water and inflates, the straps 46 will carry the cross member 45 upwardly. The tubular guides 44 cooperating with the arms of the back frame portion 41 guide the shell 20 during inflation to reduce rolling, pitching or tilting which may otherwise occur during inflation. As the shell 20 is deflated, this structure also acts to increase the stability of the shell 20 for a user seated thereon.

In addition, the back frame portion 41 provides support for a bather when the shell 20 is deflated and permits a person to sit comfortably in the bathtub with a back support.

Figure 6:
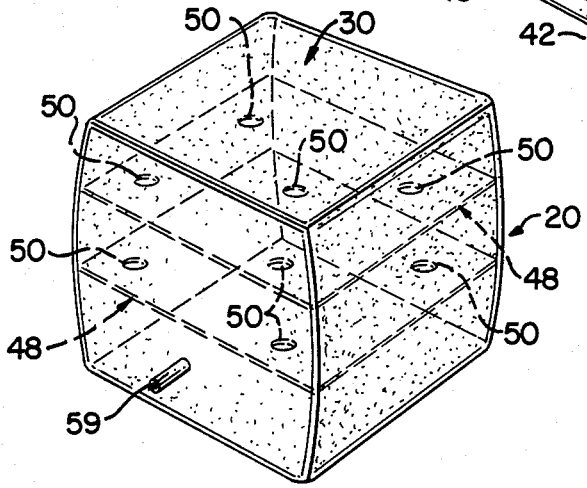
FIG. 6 is an oblique view of another embodiment of the cushion lift assembly according to the present invention showing a compartmentalized construction.

As shown in FIG. 6, the shell 20 may be provided with interior walls or panels 48 attached to the interior surfaces of the peripheral walls of the shell such that when the shell 20 is fully inflated, the interior panels 48 are generally parallel with the top panel 30 and the bottom panel, thereby dividing the shell 20 into horizontally tiered compartments. Each of the interior walls 48 is provided with a plurality of holes or apertures 50 to provide fluid communication between adjacent compartments. With this construction, the shell 20 may be inflated or deflated in stages thereby providing a more firm, secure support for the user. Furthermore, the interior panels 48 may be fashioned of substantially rigid material, thereby providing additional stability of the shell 20.

Figure 7:
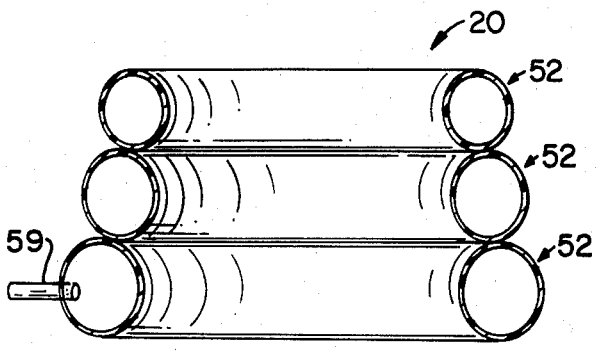
FIG. 7 is a cross sectional view of another embodiment of the cushion lift assembly according to the present invention showing another compartmentalized construction.

Another construction of a horizontally compartmentalized shell 20 is shown in FIG. 7. In this embodiment, the shell 20 includes a series of inflatable, toroidal shaped tubes 52. In the embodiment, as shown, the tubes 52 are sized to provide a generally frusto-conical overall shape for shell 20. A plurality of holes (not shown) are provided between adjacent tubes in the regions of their interfacial engagement to permit fluid communication between the interiors of adjacent tubes. This construction also permits the shell 20 to be filled in stages. Also, the uppermost tube could be constructed similar to the seat cushion 36 shown in FIG. 4 and described above to provide a ring shaped seat when the other tubes of the shell 20 are inflated or deflated. Furthermore, the tubes 52, as shown in FIG. 7, are shown as being toroidal for purposes of illustration only. The shape is not critical and it is intended that other shapes, such as a square shape, may be utilized.

Figure 8:
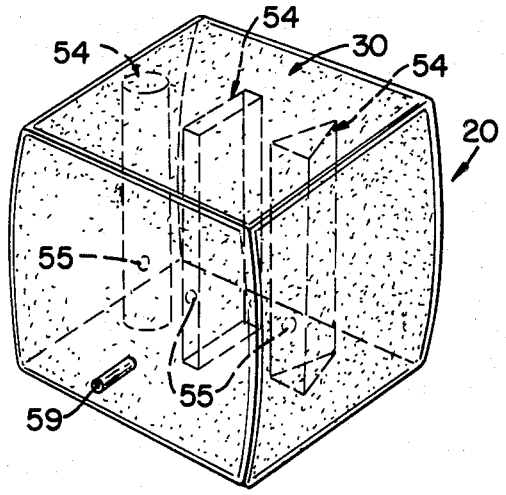
FIG. 8 is an oblique view of another embodiment of the cushion lift assembly according to the present invention having dampening strips for dampening water oscillations within the cushion.

As shown in FIG. 8, the shell 20 may be provided with dampening members 54. It has been found that when these members 54 are disposed within the shell 20, water oscillations within the shell 20 are reduced thereby increasing the stability of the overall structure. The dampening members 54 are attached to opposing interior walls of shell 20 in the embodiment shown in FIG. 8. The three dampening members 54, shown in FIG. 8, have a circular, rectangular and triangular cross-sectional shape; however, other shapes and configurations are all intended to be within the scope of this invention.

In a preferred embodiment, the dampening strips 54 are hollow and are constructed of flexible material. Holes 55 provide fluid communication between the interior of shell 20 and the interior of dampening member 54, such that when the shell 20 is inflated, the dampening members 59 are also inflated. With this arrangement, the shell 20 and dampening members 59 may be deflated together to facilitate transportation and storage of the bathtub lift cushion.

Figure 9:
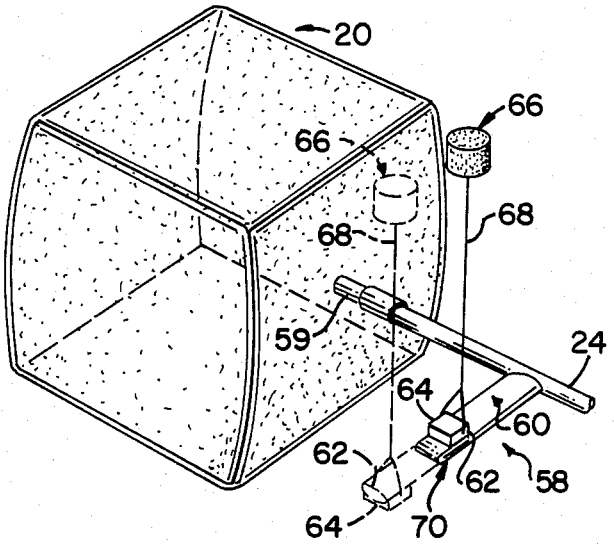
FIG. 9 is an oblique view of another embodiment of the cushion lift assembly according to the present invention showing a foldable valve assembly for controllably discharging the contents of the inflated cushion.

Another embodiment is shown in FIG. 9. In this embodiment, a foldable valve 56 is used to control the discharge of water from the inflated shell 20, and as shown here, may eliminate the need for the sleeve valve 22 as shown in FIG. 1.

The foldable valve comrises a foldable, elongate sleeve member 58 having a body portion 60 having one terminal end thereof in fluid communication with the shell 20 through a portion of the filler tube 24, or alternatively through a direct connection with shell 20. The other terminal end 62 of sleeve member 58 is open. A non-buoyant weight or closure means 64 is secured to the sleeve member 58 near the open terminal end 62 such that when the sleeve member 58 is in an unfolded position, the weight 64 lies below the sleeve member 58 adjacent the floor of the bathtub, as shown by the dotted lines of FIG. 9. A float member 66 is attached to the weight 64 by means of a cord or string 68. The float member 66 floats on the surface of the water in the bathtub and enables a person with limited maneuverability to control the foldable valve 58.

In operation, the foldable valve 58 is closed by folding the open terminal end portion 62 of the sleeve member 58 back upon the body portion 60 thereof, with the weight 64 resting upon the two folded-over sleeve portions, thereby compressing the walls of the body portion 60 together and forming a fold line 70. The fold line closes the valve 50. With the valve 50 closed, the shell 20 may be inflated. To open the foldable valve 58, the weight 64 is lifted, for example, by maneuvering the float member 66, and moved to the position denoted by the dotted lines of FIG. 9 such that the weight 64 no longer lies on the body portion 60. In this position, the foldable valve is open and the shell 20 may be deflated. With the shell 20 deflated, the user may bathe in the water filled tub, with the float member 66 floating on the water surface. Upon finishing bathing, the user simply maneuvers the float member 66 to again close the foldable valve 50 so the shell 20 may then be inflated with water.

A cover may be fitted over the top portion of shell 20 when in use and removed after use so that the bathtub lift cushion may be left in the inflated condition between uses. The user takes the cover with him and the next user places a new cover over the shell 20. In this manner, the bathtub lift cushion may be kept in a hygenic condition and without the need of deflating the assembly after each bath. The cover may be attached to the shell 20 by snaps, Velcro strips, adhesives or the like and may be disposable.

Figure 10:
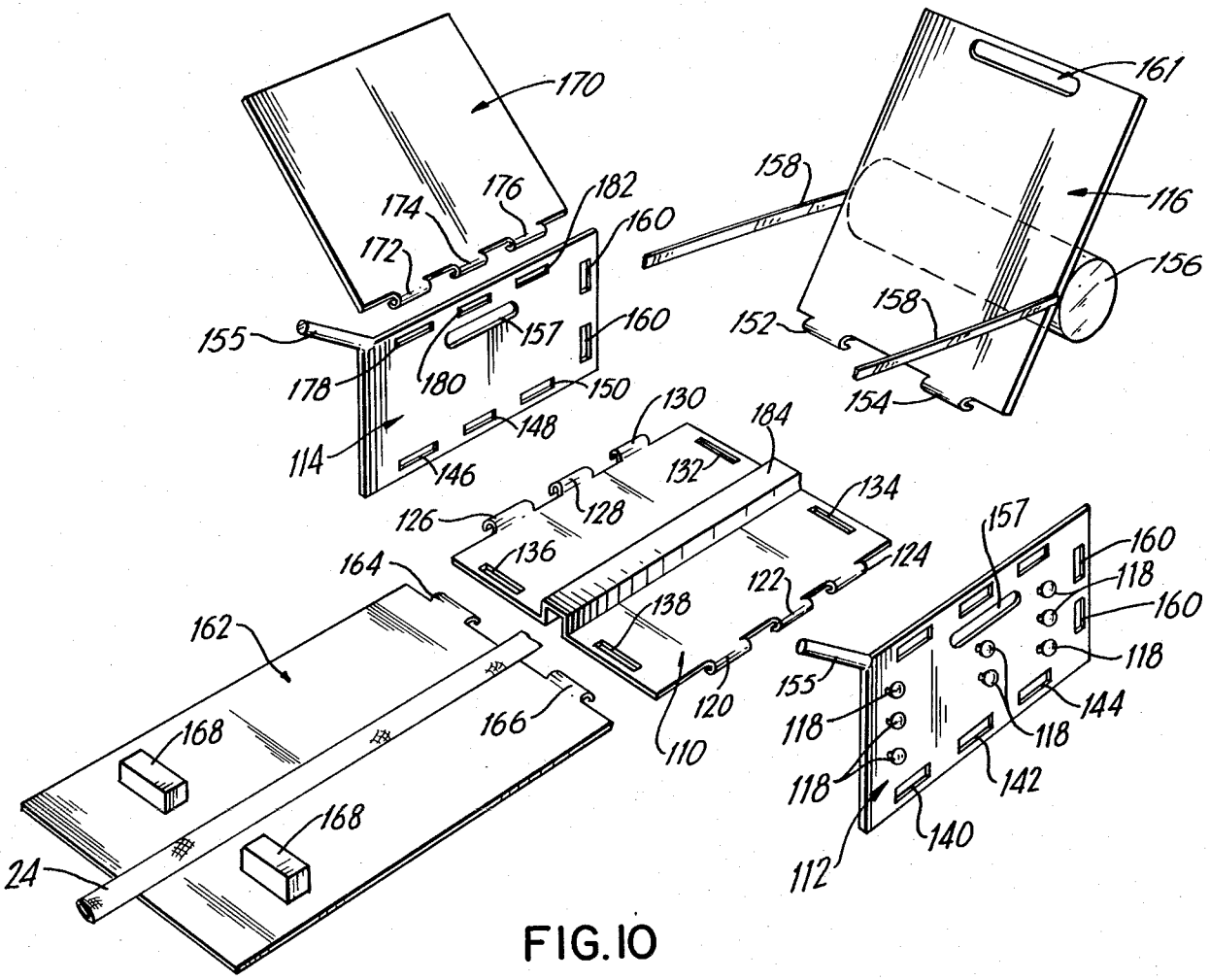
FIG. 10 is an exploded view of another embodiment of the cushion lift assembly according to the present invention showing a plurality of interconnecting plates generally lining the side walls, rear wall, and floor of the bathtub for assisting a bather safely in getting on and off a cushion lift and in maneuvering himself safely within the bathtub.

FIG. 10 discloses yet another embodiment of the present invention wherein a plurality of interconnecting plates generally lining the side walls, rear wall, and floor of the bathtub are utilized to assist a bather safely in getting on and off a cushion lift (not shown) and in maneuvering himself safely within the bathtub during bathing. The interconnecting plates include a floor plate 110, two side plates 112, 114, and a back plate 116. Each of the plates is fashioned of substantially rigid material in a preferably rectangular configuration.

The floor plate 110 is adapted for interfacial engagement with the bathtub floor, but may also be raised slightly above the bathtub floor by such means as short supporting legs. The movement of the floor plate 110 along the bathtub floor is inhibited by friction enhancing means such as suction cups (not shown) attached to the undersurface of the floor plate 110. Each side plate 112, 114 generally lines a corresponding interior side wall of the bathtub. A plurality of suction cups 118 disposed on each side plate surface facing the corresponding bathtub interior side wall attaches each side plate 112, 114 to the corresponding bathtub interior side wall. The side plates 112, 114 may be attached to the bathtub interior side walls by other means, which include utilizing a U-shaped clamp to compressively engage together a side plate and a bathtub side wall between its jaws. The back plate 116 is positioned adjacent to the rear wall of the bathtub and is adapted for adjustable inclination with respect to the bathtub floor.

The plates preferably are interconnected to each other by any suitable means such as straps, Velcro strips, hinges and the like, but as shown in FIG. 10, the preferred interconnecting means is the provision of curled or hooked fingers extending from an edge of a plate for projecting into corresponding slots along an adjacent edge of an adjacent plate to thereby grasp and hold the adjacent plate. More particularly, there is shown in FIG. 10 the floor plate 110 provided with a series of three curled fingers 120, 122, 124 along one edge thereof, another series of three curled fingers 126, 128, 130 along the opposite edge thereof, a series of two slots 132, 134 along a third edge thereof, and another series of slots 136, 138 along the fourth edge thereof. One series of curled fingers 120, 122, 124 projects into a corresponding series of slots 140, 142, 144 along the lowermost edge of one of the side plates 112, while the other series of curled fingers 126, 128, 130 projects into a corresponding series of slots 146, 148, 150 along the lowermost edge of the other side plate 114. The lowermost edge of the back plate 116 is also provided with a series of two curled fingers 152, 154 for projecting into a corresponding series of slots 132, 134 along the third edge of the floor plate 110.

Each of the side plates 112, 114 may be provided with a knob or handle 155 projecting generally outwardly and upwardly from a position near the topmost edge thereof and may be provided with a slot 157 of a size sufficient for a human hand to extend therethrough near the topmost edge thereof. The handle 155 and the slot 157 may be grasped by a bather to assist the bather in getting on and off a bathtub lift and also in maneuvering himself within the bathtub. To this end, each side plate 112, 114 should be high enough relative to the rim of the bathtub side wall to accomodate the grasping of either the handle 155, the slot 157, or both by the bather. Optionally, the top section of a side plate may be hingedly connected to the lower section thereof to facilitate the bather's entry to and exit from the bathtub. When the bather enters or exits the bathtub the top section would be rotated downwardly and when the bather is bathing the top section would be latched in an upright position. Alternatively, if a U-shaped clamp is used to attach the side plate to a bathtub side wall, the clamp may be grasped as a handle by the bather.

The back plate 116 may be adjustably inclined with respect to the bathtub floor by several well-known means, but as depicted in FIG. 10, the preferred means includes an inflatable cylindrically shaped pillow 156 resting on the bathtub floor and disposed between the rear wall of the bathtub and the back plate 116. The back plate 116 serves as a back rest for the bather, and is preferably sized to also serve as a head rest for the bather. Further, the back plate 116 may be provided with a padding or a cushion against which the bather rests. The pillow 156 should be sized so that the the back plate 116 extends in a vertical direction when the pillow 156 is inflated. The angle of inclination of the back plate 116 with the bathtub floor may be limited by either the size of the pillow 156 when partially deflated, abutment of the back plate 116 with the rear wall of the bathtub, or other means such as straps 158 connected to the back plate 116 and adapted to be secured to the side plates 112, 114 through slits 160 along the edge of each side plate 112, 114 nearest to the rear wall. The back plate 116 additionally may be provided with a slot 161 near the topmost edge thereof for grasping by the bather and may be attached to the pillow 156 by means of straps or the like.

Another means for adjustably inclining the back plate 116 with respect to the bathtub floor is by utilizing at least one pair of telescoping tubes (not shown) and arranging the tubes such that one non-overlapping tube end securely abuts the back plate 116 and the other non over-lapping tube end securely abuts the bathtub rear wall so that the telescoping tubes do not slip along the back plate 116 or along the rear wall during use. The overlapping tube ends each may be provided with a series of alignable holes through which a pin may be inserted to maintain the telescoping tubes at any of several desired lengths and to thereby maintain said back plate 116 at any of several selected inclinations with respect to the bathtub floor.

Also shown in FIG. 10 is a floor mat 162 fashioned in a rectangular configuration and adapted for interfacial engagement with the bathtub floor. The edge of the floor mat 162 closest to the floor plate 110 is providee with a series of two curled fingers 164, 166 for projecting into a corresponding series of slots 136, 138 along the fourth edge of the floor plate 110. A plurality of blocks 168 are integral with the floor mat 162 and alternately may be attached, and preferably removably attached, by suitable means to the top surface of the floor mat 162 and may be preferably adjustably positioned thereon. The blocks 168 serve as foot or leg stump braces for aiding a bather's maneuvers in the bathtub. In view of this function of the blocks 168, it is important that the blocks 168 are stationary relative to the structure generally supporting the bather. Additionally the floor mat 162 is preferably less slippery than the bathtub floor and thereby also aids bather maneuvering. The floor mat 162 may be secured to each of the side plates 112, 114 by suitable bracing (not shown) attached to the adjacent-most corners of the floor mat 162 and each of the side plates 112, 114.

In operation, a bathtub lift (not shown) is placed on the floor plate 110. Since the bathtub lift is preferably an inflatable bathtub cushion lift such as described in U.S. Pat. No. 3,771,176 or such as previously described in this specification, the operation of the interconnecting plates and mat will be discussed with reference to a preferred bathtub lift, although it should be understood that other bathtub lifts may be utilized. The lift is inflated such that side wall portions of the lift compressively engage the side plates 112, 114 against the bathtub side walls and such that the top surface of the lift is at a height substantially equal to the height of the bathtub walls. The pillow 156 is also inflated so that the back plate 116 is vertically postioned. A bather slides over the rim of the bathtub side wall and onto the lift with the aid of the handles 155 and the slots 157. Thus, it can be appreciated that the side plates 112, 114 should remain stationary with respect to the bathtub side walls. While such a stationary condition may be achieved by the suction cups 118, a U-clamp, or other means, it is preferable that the stationary condition be additionally achieved and insured through the interconnection of the side plates 112, 114 with the floor plate 110, through the bracing of the side plates 112, 114 with the floor mat 162, and through the lift's compressive engagement against the side plates 112, 114. Although the slot 161 in the back plate 116 may also be utilized by the bather, the back plate is steadied only by its sandwiching between the lift and the pillow 156 and therefore is relatively steady only when the lift is virtually fully inflated.

Many persons confined to wheelchairs utilize a board extending between and resting on the edge of the wheelchair and the rim of the bathtub to transfer themselves from the wheelchair to the bathtub. Since many of these transfer boards are susceptible to sliding, the present invention contemplates a transfer board 170 secured to a side plate. As shown in FIG. 10, the transfer board 170 may be so secured by the provision of a series of three curled fingers 172, 174, 176 along an edge thereof for projecting into a corresponding series of slots 178, 180, 182 along the topmost edge of one of the side plates 114. Alternatively, the transfer board 170 may be secured to the side plate by other means such as a tongue and groove arrangement. To facilitate the use of the transfer board 170, the handle 155 nearest to the transfer board may be retractable, detachable or pivoted so that the handle 155 will not obstruct the bather's transfer. Optionally, the transfer board 170 may be strapped to the wheelchair.

Once the bather is positioned on top of the inflated lift, he may operate the lift for bathing as previously described in this specification. During bathing, the bather may use the handles 155, slots 157, and blocks 168 to assist his maneuvering within the bathtub. Upon completion of bathing, the bather reinflates the lift and gets off the inflated lift again using the handles 155 and slots 157, 161 (and, if desired, the transfer board 170).

The pillow 156 may be inflated and deflated simultaneously with, or independently of, the lift. Moreover, the filler tube 24 to the lift may be branched into two branch tubes, one of the branch tubes communicating with the interior of the shell 20 and the other branch tube communicating with the interior of the pillow 156. The latter branch tube and the pillow 156 may be provided with any of the various kinds of valves previously discussed.

As shown in FIG. 10, the floor plate 110 may be provided with a channel 184 passing from the front thereof to the rear thereof for permitting water otherwise trapped between the rear wall of the lift and the rear wall of the bathtub to flow to the bathtub drain. Also as shown in FIG. 10, the filler tube 24 may be integral with the floor mat 162 for at least a portion thereof. Alternately, the filler tube 24 may lie in a longitudinal recess in the top surface of the floor mat 162 or may lie beneath the floor mat 162 in a longitudinal recess in the bottom surface thereof.

From the foregoing description of the embodiment of the present invention shown in FIG. 10, it should be evident that the side plates, back plate, and floor mat each may be used alone or in varying degrees of combination with the other elements recited. Moreover, the present invention also contemplates the strapping or harnessing of a bather by suitable means to a plate or mat. It should also be evident that whenever it has been stated that fingers extend from one plate, mat, or board and project into slots in adjacent elements, it is of course contemplated that the fingers extend from such adjacent element into slots in the plate, mat, or board. Recitation of any such finger/slot arrangement in the claims appended hereto should be construed to cover either arrangement.

Although particular embodiment of the present invention have been described and illustrated herein, it should be recognized that modifications and variations may readily occur to those skilled in the art and that such modifications and variations may be made without departing from the spirit and scope of my invention. Accordingly, all such modifications and variations are included in the scope of the inventions as defined by the following claims:

I claim:

1. A bathtub lift assembly for use in a bathtub including a bathtub lift adapted to be disposed in and supported by the bathtub and having a seat for supporting a bather, means for positioning said seat at any selected elevation intermediate a first position substantially coplanar with the rim of the side walls of the bathtub and a second position adjacent to the floor of the bathtub, at least one side plate adapted to be disposed adjacent to the interior surface of a bathtub side wall, means for releasably maintaining said side plate in a stationary relation with respect to the adjacent bathtub side wall, and means associated with said side plate against which the bather may apply a force to aid his locomotion in the vicinity of the bathtub.

2. The bathtub cushion lift assembly according to claim 1 wherein said means associated with said side plate comprises a handle carried by said side plate.

3. The bathtub cushion lift assembly according to claim 2 wherein said handle is releasably carried by said side plate.

4. The bathtub cushion lift assembly according to claim 1 wherein said side plate is provided with a slot located along the topmost edge thereof, said slot being of a size sufficient for the fingers of the bather's hand to extend therethrough and wherein said means associated with said side plate comprises the portion of said plate between said slot and the topmost edge of said side plate.

5. A bathtub lift assembly for use in a bathtub including a bathtub lift adapted to be disposed in and supported by the bathtub and having a seat for supporting a bather, means for positioning sid seat at any selected elevation intermediate a first position substantially coplanar with the rim of the side walls of the bathtub and a second position adjacent to the floor of the bathtub, at least one side plate adapted to be disposed adjacent to the interior surface of a bathtub side wall, means for releasably maintaining said side plate in a stationary relation with respect to the adjacent bathtub side wall, a board for aiding the bather in transporting himself from a location slightly remote from the bathtub to the bathtub side wall adjacent to said side plate, and means for connecting said board and said side plate.

6. The bathtub lift assembly according to claim 5 wherein said side plate is provided with a plurality of slots along the topmost edge thereof and wherein said means for connecting said board and said side plate comprises a plurality of curled fingers carried by said board and extending from an end thereof, each of said curled fingers adapted to project into a corresponding slot in said plate to thereby grasp and hold said side plate.

7. A bathtub lift assembly for use in a bathtub including a floor plate adapted to be disposed adjacent to the bathtub floor, a bathtub lift adapted to be supported by said floor plate and having a seat for supporting a bather, means for positioning said seat at any selected elevation intermediate a first position substantially coplanar with the rim of the side walls of the bathtub and a second position adjacent to the floor plate, a back plate adapted to be disposed in the bathtub and adapted to support the back of a bather, means for pivotably connecting an end of said back plate to said floor plate, and means for maintaining said back plate at a selected inclination with respect to said floor plate and for selectively changing the inclination of said back plate with respect to said floor plate.

8. The bathtub lift assembly according to claim 7 wherein said floor plate is provided with a plurality of slots along the edge thereof closest to the pivotably connected end of said back plate and wherein said means for pivotably connecting an end of said back plate to said floor plate comprises a plurality of curled fingers carried by said back plate and extending from the pivotably connected end thereof, each of said curled fingers adapted to project into a corresponding slot in said floor plate to thereby pivotably grasp and hold said floor plate.

9. The bathtub lift assembly according to claim 7 wherein said means for maintaining and selectively changing comprises an inflatable pillow adapted to be disposed between a wall of the bathtub and said back plate.

10. The bathtub lift assembly according to claim 7 further including a floor mat adapted to be disposed adjacent to the floor of bathtub beside said floor plate, at least one block carried by said floor mat against which the bather may apply a force to aid his locomotion within the bathtub, and means for maintaining said floor mat in stationary relation with respect to said floor plate.

11. The bathtub lift assembly according to claim 10 wherein said block is releasably connected to and adjustably positioned on said floor mat.

12. The bathtub lift assembly according to claim 10 wherein said floor plate is provided with a second plurality of slots along the edge thereof opposite to the edge thereof closest to the pivotably connected end of said back plate and wherein said means for maintaining said floor mat in a stationary relation with respect to said floor plate comprises a plurality of curled fingers carried by said floor mat and extending from an end thereof, each of said curled fingers extending from an end of said floor mat adapted to project into a corresponding slot of said second plurality of slot to thereby grasp and hold said floor plate.

13. The bathtub lift assembly according to claim 12 further including at least one side plate adapted to be disposed adjacent to the interior surface of a bathtub side wall, means for releasably maintaining said side plate in a stationary relation with respect to the adjacent bathtub side wall, a handle carried by said side plate against which the bather may apply a force to aid his locomotion in the vicinity of the bathtub, said side plate provided with a plurality of slots along the lowermost edge thereof, and a plurality of curled fingers carried by said floor plate and extending from an end thereof, each of said curled fingers extending from an end of said floor plate adapted to project into a corresponding slot of said plurality of slots in said side plate to thereby grasp and hold said side plate.

14. The bathtub lift assembly according to claim 7 wherein said means for maintaining and selectively changing comprises at least one pair of telescoping tubes adapted to be disposed between a wall of the bathtub and said back plate and arranged such that one non-overlapping tube end abuts the bathtub wall and the other non-overlapping tube end abuts the back plate, the overlapping tube ends each being provided with a series of alignable holes through which a pin may be inserted.

15. A bathtub lift assembly for use in a bathtub including a floor plate adapted to be disposed adjacent to the bathtub floor, a bathtub lift adapted to be supported by said floor plate and having a seat for supporting a bather, means for positioning said seat at any selected elevation intermediate a first position substantially coplanar with the rim of the side walls of the bathtub and a second position adjacent to the floor plate, a floor mat adapted to be disposed adjacent to the floor of the bathtub beside said floor plate, and means for maintaining said floor mat in a stationary relation with respect to said floor plate, and means for connecting said floor plate to said floor mat.

16. A bathtub lift assembly for use in a bathtub including a floor plate adapted to be disposed adjacent to the bathtub floor, a bathtub lift adapted to be supported by the said floor plate and having a seat for supporting a bather, means for positioning said seat at any selected elevation intermediate a first position substantially coplanar with the rim of the side walls of the bathtub and a second position adjacent to the floor of the bathtub, at least one side plate adapted to be disposed adjacent to the interior surface of a bathtub side wall, means for releasably maintaining said side plate in a stationary relation with respect to the adjacent bathtub side wall, means associated with said side plate against which the bather may apply a force to aid his locomotion in the vicinity of the bathtub, and means for connecting said side plate to said floor plate.

17. In a cushion lift assembly for use in a bathtub having a floor and side walls, said assembly having a water inflatable cushion shell of flexibly substantially non-elastic material with side wall portions compressively engaging the bathtub side walls, the improvement comprising:

a bottom panel of said assembly being adapted to be disposed in interfacial engagement with the floor of said bathtub and having a substantially rigid portion for substantially preventing displacement of the cushion shell in the bathtub during use.

18. In a cushion lift assembly for use in a bathtub having a floor and side walls, said assembly having a water inflatable cushion shell of flexibly substantially non-elastic material with side wall portions compressively engaging the bathtub side walls, the improvement comprising:

a top panel of said assembly being adapted to be disposed at any selected elevation intermediate a first position substantially coplanar with the upper edge of the side walls of the bathtub and a second position adjacent the floor of the bathtub and said top panel being provided with a substantially rigid seat panel positioned on the top surface of the top panel.

19. The improved cushion fit assembly according to claim 18 wherein the seat panel is removably disposed on the top panel.

20. In a cushion lift assembly for use in a bathtub having a floor and side walls, said assembly having a water inflatable cushion shell of flexibly substantially non-elastic material with side wall portions compressively engaging the bathtub side walls, the improvement comprising:

a top panel of said assembly being adapted to be disposed at any selected elevation intermediate a first position substantially coplanar with the upper edge of the side walls of the bathtub and a second position adjacent the floor of the bathtub and said top panel being provided with a seat panel comprising an inflatable air cushion which is positioned on the top surface of the top panel.

21. In a cushion lift assembly for use in a bathtub having a floor and side walls, said assembly having an inflatable cushion shell of flexibly substantially non-elastic material with side wall portions compressively engaging the bathtub side walls, said assembly being connected to a water inlet of the bathtub for inflating the shell with water, the improvement comprising:

a foldable valve means operable by a user from an open position for permitting water within the shell to be discharged to a closed position for retaining water within the shell.

22. The improved cushion lift assembly according to claim 21 wherein the foldable valve means includes a foldable elongate sleeve member having a body portion in fluid communication with the shell and an open terminal end portion and further includes closure means adjacent the open terminal end portion for maintaining the open terminal end portion in a folded back interfacial engagement with said body portion whereby the folded line resulting therefrom comprises a closed valve assembly.

23. The improved cushion lift assembly according to claim 22 further including a float and means for connecting the float to the closure means, the float being displaceable by a user to effect displacement of the closure means to open or close the foldable valve means.

24. In a cushion lift assembly for use in a bathtub having a floor and side walls, said assembly including a water inflatable cushion shell of flexibly, substantially non-elastic material and a bottom panel adapted to be disposed adjacent the floor of the bathtub and with side wall portions compressively engaging the bathtub side walls, the improvement comprising:

a top panel of said assembly being adapted to be disposed at any selected elevation intermediate a first position substantially coplanar with the upper edge of the side walls of the bathtub and a second position adjacent the floor of the bathtub;

a frame sized to be contained within said bathtub including, a base member positionable intermediate the floor of the bathtub and the bottom panel;

a back support member disposed substantially perpendicular to the base member and size to extend upwardly at least to the top of the bathtub; and means associated with the cushion shell and engagable with the back support member for maintaining an edge of the top panel in contiguous relation with the back support at all elevations of the top panel intermediate the first and second positions thereof.

25. In a cushion lift assembly for use in a bathtub having a floor and side walls, said assembly having a water inflatable cushion shell of flexibly substantially non-elastic material with side wall portions compressively engaging the bathtub side walls the improvement comprising:

an interior baffle wall within the shell attached to interior walls of the cushion shell to form compartments within the shell; and means for directing water from one compartment to another.

26. In a cushion lift assembly for use in a bathtub having a floor and side walls, said assembly having a water inflatable cushion shell of flexibly substantially non-elastic material with side wall portions compressively engaging the bathtub side walls the improvement comprising:

dampening members attached to an interior wall of the cushion shell for dampening water motion within the cushion shell.

27. A cushion lift assembly for use in a bathtub comprising a series of at least two inflatable, toroidal tubes disposed adjacent to and generally above each other together with means for providing fluid communication between adjacent tubes.

28. A cushion lift assembly for use in a bathtub comprising an inflatable cushion, a flexible cover adapted to be fitted over a top portion of said inflatable cushion, and means for removably attaching said flexible cover to said inflatable cushion.

29. The bathtub lift assembly according to claim 15 wherein said floor mat has at least one block carried by said floor mat against which the bather may apply a force to aid his locomotion within the bathtub.

30. The bathtub lift assembly according to claim 29 wherein said block is releasably connected to and adjustably positioned on said floor mat.

* * * * *